US005476430A

United States Patent [19]

Lee et al.

[11] Patent Number: 5,476,430

[45] Date of Patent: Dec. 19, 1995

[54] EXERCISE TREADMILL WITH VARIABLE RESPONSE TO FOOT IMPACT INDUCED SPEED VARIATION

[75] Inventors: Michael G. Lee, Sultan; Kelley A. Timmins, Redmond, both of Wash.

[73] Assignee: Lumex, Inc., Bay Shore, N.Y.

[21] Appl. No.: 331,227

[22] Filed: Oct. 28, 1994

[51] Int. Cl.[6] ..... A63B 22/02

[52] U.S. Cl. ..... 482/54; 482/3; 482/4; 482/6; 482/7

[58] Field of Search ..... 482/26, 1–8, 70, 482/71, 900, 901; 119/700–704

[56] References Cited

U.S. PATENT DOCUMENTS

| | | | |
|---|---|---|---|
| 3,711,812 | 1/1973 | Cherry . | |
| 4,635,927 | 1/1987 | Shu . | |
| 4,635,928 | 1/1987 | Ogden et al. . | |
| 4,643,418 | 2/1987 | Bart . | |
| 4,749,181 | 6/1988 | Pittaway et al. . | |
| 4,842,266 | 6/1989 | Sweeney et al. . | |
| 5,062,632 | 11/1991 | Dalebout et al. . | |
| 5,104,119 | 4/1992 | Lynch . | |
| 5,205,800 | 4/1993 | Grant | 482/54 |
| 5,250,012 | 10/1993 | Meredith | 482/54 |
| 5,279,528 | 1/1994 | Dalebout et al. | 482/54 |

FOREIGN PATENT DOCUMENTS

| | | | |
|---|---|---|---|
| 0196877 | 10/1986 | European Pat. Off. | 482/54 |

*Primary Examiner*—Richard J. Apley
*Assistant Examiner*—Glenn E. Richman
*Attorney, Agent, or Firm*—Graybeal Jackson Haley & Johnson

[57] ABSTRACT

Exercise treadmill with motor driven tread belt and means for varying the tread belt speed by a speed control system which makes available to the treadmill user a plurality of nominal speeds and also a plurality of rates of restoration of the tread belt speed upon the occurrence of a change in load on the moving tread belt resulting from the user's foot plant impact on the tread belt. By selection by the user of one of the plurality of available rates of restoration of tread belt speed, the user through the user operated speed control can select a desired "stiffness" or "softness", otherwise known as "feel", to reduce user foot plant induced stress or trauma. The preferred speed control system involves a variable speed DC motor with a microprocessor controlled SCR phase control power module, the microprocessor including program memory with plural sets of program values, each with respective delta gain, loop gain and maximum power values.

11 Claims, 10 Drawing Sheets

FEEL

| SPEED (MPH) | F1 | F2 | F3 | F4 | F5 | F6 | F7 | F8 | F9 |
|---|---|---|---|---|---|---|---|---|---|
| | | | | | | | | | |
| 0.0 - 0.4 | 436 | 436 | 436 | 436 | 436 | 436 | 436 | 436 | 436 |
| 0.5 - 0.9 | 436 | 436 | 436 | 436 | 436 | 436 | 436 | 436 | 436 |
| 1.0 - 1.4 | 436 | 436 | 436 | 436 | 436 | 436 | 436 | 436 | 436 |
| 1.5 - 1.9 | 436 | 436 | 436 | 436 | 436 | 436 | 436 | 436 | 436 |
| 2.0 - 2.4 | 623 | 623 | 623 | 433 | 444 | 444 | 445 | 435 | 436 |
| 2.5 - 2.9 | 622 | 622 | 623 | 434 | 444 | 444 | 445 | 435 | 436 |
| 3.0 - 3.4 | 621 | 622 | 633 | 534 | 444 | 445 | 545 | 435 | 436 |
| 3.5 - 3.9 | 621 | 622 | 633 | 534 | 534 | 545 | 545 | 435 | 436 |
| 4.0 - 4.4 | 621 | 623 | 623 | 625 | 625 | 626 | 636 | 536 | 526 |
| 4.5 - 4.9 | 621 | 623 | 624 | 626 | 626 | 626 | 626 | 637 | 637 |
| 5.0 - 5.4 | 621 | 623 | 625 | 627 | 627 | 627 | 627 | 627 | 628 |
| 5.5 - 5.9 | 621 | 623 | 625 | 728 | 728 | 728 | 628 | 628 | 728 |
| 6.0 - 6.4 | 621 | 623 | 625 | 729 | 729 | 729 | 729 | 719 | 819 |
| 6.5 - 6.9 | 623 | 624 | 626 | 729 | 729 | 729 | 729 | 719 | 819 |
| 7.0 - 7.4 | 625 | 626 | 627 | 729 | 729 | 729 | 729 | 719 | 819 |
| 7.5 - 7.9 | 626 | 627 | 628 | 729 | 729 | 729 | 729 | 719 | 819 |
| 8.0 - 8.4 | 628 | 628 | 628 | 729 | 729 | 729 | 729 | 829 | 819 |
| 8.5 - 8.9 | 628 | 628 | 628 | 729 | 729 | 729 | 729 | 829 | 819 |
| 9.0 - 9.4 | 628 | 628 | 628 | 729 | 729 | 729 | 729 | 829 | 819 |
| 9.5 - 9.9 | 628 | 628 | 628 | 729 | 729 | 729 | 729 | 819 | 819 |
| 10.0 - 10.4 | 628 | 628 | 628 | 729 | 729 | 729 | 819 | 819 | 819 |
| 10.5 - 10.9 | 628 | 628 | 628 | 729 | 729 | 729 | 819 | 819 | 819 |
| 11.0 - 11.4 | 628 | 628 | 628 | 729 | 729 | 729 | 819 | 819 | 819 |

FIG. 9

CORELATION OF TABLE AND SURROGATE VALUES

| | TABLE VALUE | SURROGATE VALUE |
|---|---|---|
| DELTA GAIN | 4 | 35 |
| | 5 | 50 |
| | 6 | 70 |
| | 7 | 90 |
| | 8 | 110 |
| LOOP GAIN | 1 | 4 |
| | 2 | 8 |
| | 3 | 12 |
| MAXIMUM POWER | 1 | 110 |
| | 2 | 240 |
| | 3 | 420 |
| | 4 | 650 |
| | 5 | 1400 |
| | 6 | 2200 |
| | 7 | 3800 |
| | 8 | 5200 |
| | 9 | 9000 |

FIG. 10

EXERCISE TREADMILL WITH VARIABLE RESPONSE TO FOOT IMPACT INDUCED SPEED VARIATION

BACKGROUND OF THE INVENTION

1. Field of the Invention

The present invention relates to power driven exercise treadmills and more particularly to such treadmills wherein the moving tread belt is a power driven endless belt having a variable but nominally constant speed and also variable means by which dynamic, incremental changes in belt speed occur as a result of dynamic, incremental changes in loading on the belt resulting from the user's foot impact on the belt.

2. Description of the Prior Art

Power driven exercise treadmills are well known, such as disclosed in Sweeney et al U.S. Pat. No. 4,842,266, wherein the treadmill has a power driven tread belt, the speed of which is manually selected and automatically maintained on a dynamic nominally constant basis and in which control commands are entered in a display panel and input to a microprocessor which in turn controls the drive motor speed. However, while such power driven treadmills are characteristically designed to be selectively speed variable, they also characteristically involve a compromise as to what may be termed tread belt "softness", i.e. the rate of restoration of nominal belt speed, i.e. rate of restabilization of a set, nominally constant speed when subject to so-called "foot plant" variations in belt loading and consequent dynamic change in belt speed.

A major cause of the stress and trauma associated with normal walking and running on a treadmill is known as "foot plant". "Foot plant" refers to the alternation of body weight from foot to foot as a user walks or runs on the moving tread belt. When the user does this, switching his or her body weight and support from one foot to the other, the user's forward motion is temporarily interrupted, introducing the possibility of subjecting the user's joints and muscles to stress and trauma. When the running surface can absorb some of the foot impact force, the stress is reduced, but there is also a risk of inconsistent support of the user if the tread surface is too "soft", i.e. where the variation in speed resulting from change in loading is too large.

SUMMARY OF THE INVENTION

Treadmills according to the present invention in part address the foot plant stress problem by forming the deck underlying the treadmill belt as one piece and extending it to substantially the entire length of the tread belt. The deck is mounted on resilient strips extending entirely along both the bottom edge and the sides of the deck, which allows the impact force of each foot plant to dissipate to some extent throughout the entire deck while providing an evenly and consistently supported running surface.

Treadmills according to the present invention address the problem of foot plant stress and trauma by uniquely providing means by which the user can select the degree of "softness" or "stiffness" (also called "firmness") in the belt's response to foot plant induced change in loading and consequent incremental change in belt speed. It is conventional in previous treadmill design practice for the degree of "softness" or "stiffness" to be preset, i.e. built into the treadmill design to respond but one way to dynamic change in belt speed. In contrast, the treadmill of the present invention provides means by which the user can select any one of a plurality of different degrees of "softness" or "stiffness" (which can otherwise be termed degrees of "feel"), i.e. any one of a plurality of different rates of restoration of nominal belt speed for any one of a plurality of nominal belt speeds. In the preferred embodiment of controlled impact running system presented by the following disclosure, nine different degrees of "feel" are provided in this respect, by way of example.

For a user to be able to change or individualize the rate of response to dynamic change in belt speed is a significant advantage because every user has a different and distinct stride, weight and foot plant (the way the foot is put down, rolls and is picked up), and different exercise programs require or at least make it desirable for a user to have a different "feel" available for different types of exercise (running versus walking, for example). If the belt recovers the nominally set speed too quickly (the belt is too "stiff"), the belt can aggressively grab the user's foot at each step, yielding a very undesirable trauma situation. If the set speed restorative response is too slow (too "soft"), the user can experience a mushy sensation on every step, which tends to be annoying and unduly tiring because it feels unnatural and unstable.

This invention offers the user the freedom to selectively choose how the user would like the treadmill to respond to the user's personal foot plant at any given time. The need for such a choice, and the advantages thereof, are more pronounced at faster (e.g. running) speeds than at slower (e.g. walking) speeds, primarily because the shock and change in loading on the belt is greater while the user is running than when walking.

These and other features, advantages and characteristics of the invention will occur to those skilled in the art to which the invention is addressed in the light of the following description and illustration of certain preferred embodiments thereof.

BRIEF DESCRIPTION OF THE DRAWINGS

FIG. 9 is a tabular showing of the relative numeric values for delta gain, loop gain and maximum power inputs for various belt speeds and "feel" settings according to the preferred embodiment of the invention.

FIG. 10 is a tabulation showing of the numeric values appearing in the table of FIG. 9 to the numeric surrogate values used in the motor speed control computations.

DETAILED DESCRIPTION OF THE PREFERRED EMBODIMENT

Figure 1:
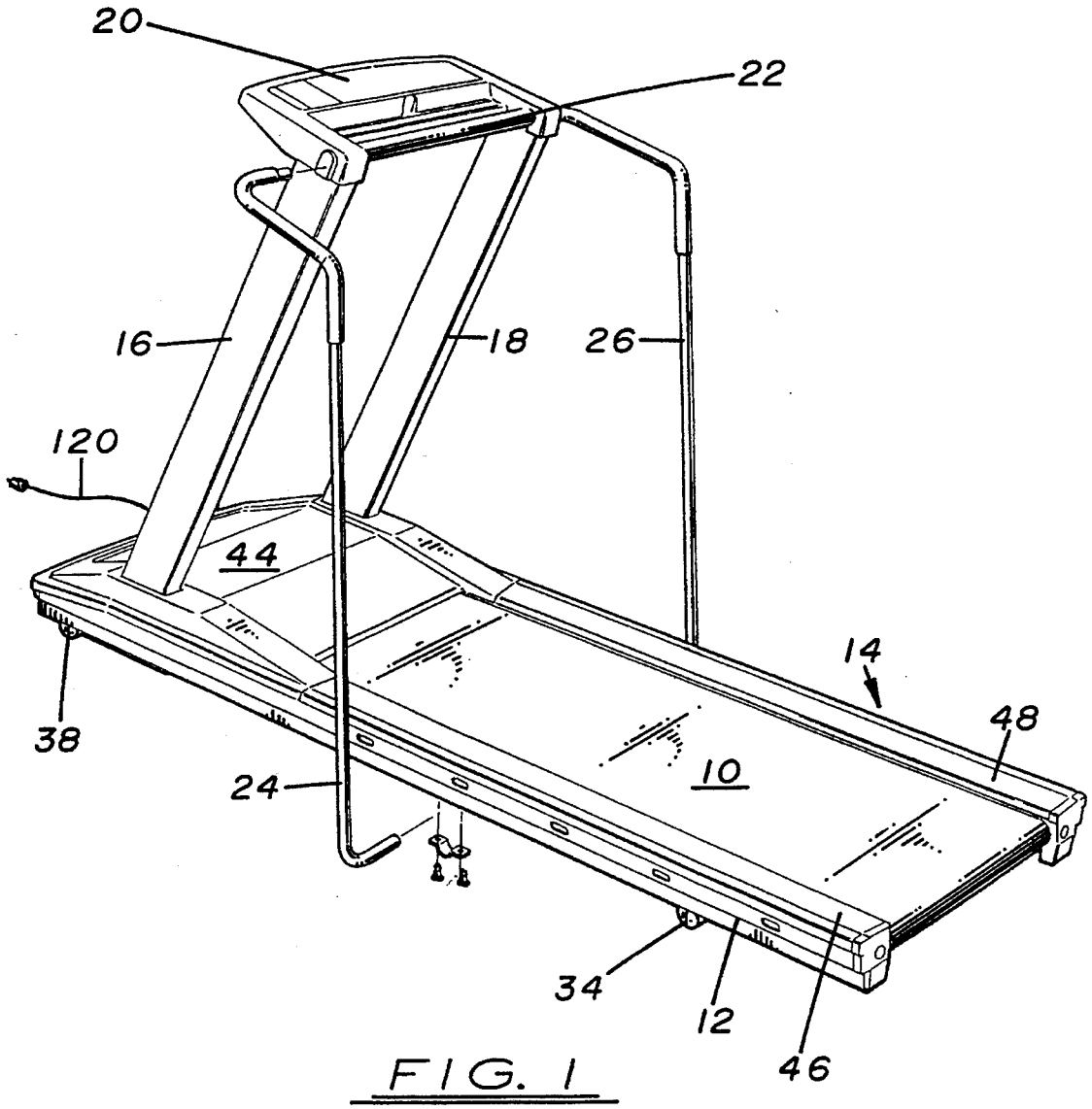
FIG. 1 is an isometric, partially exploded view of the assembled treadmill.
Figure 2:
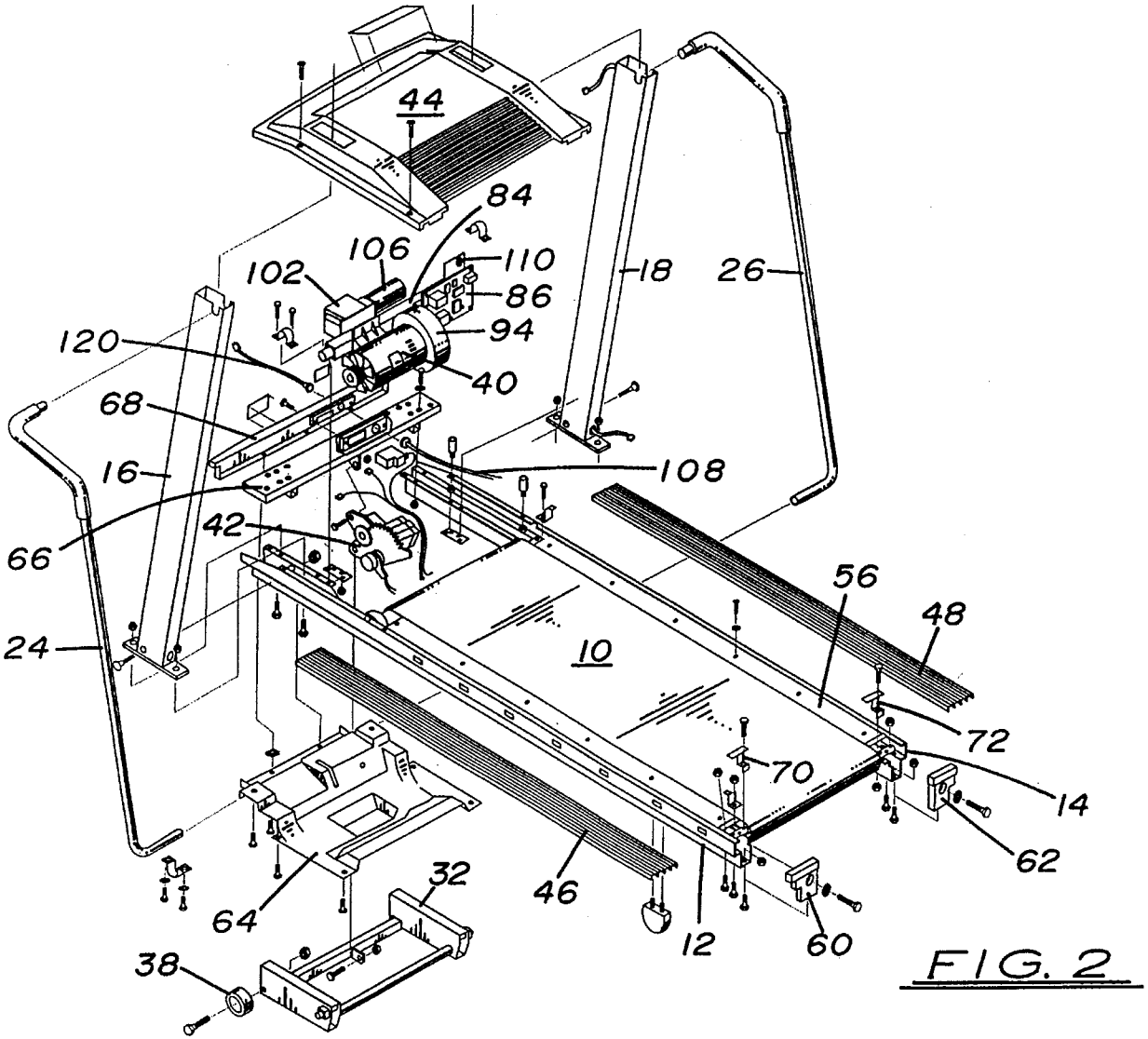
FIG. 2 is an exploded iosmetric view of various parts of the treadmill shown in FIG. 1.
Figure 3:
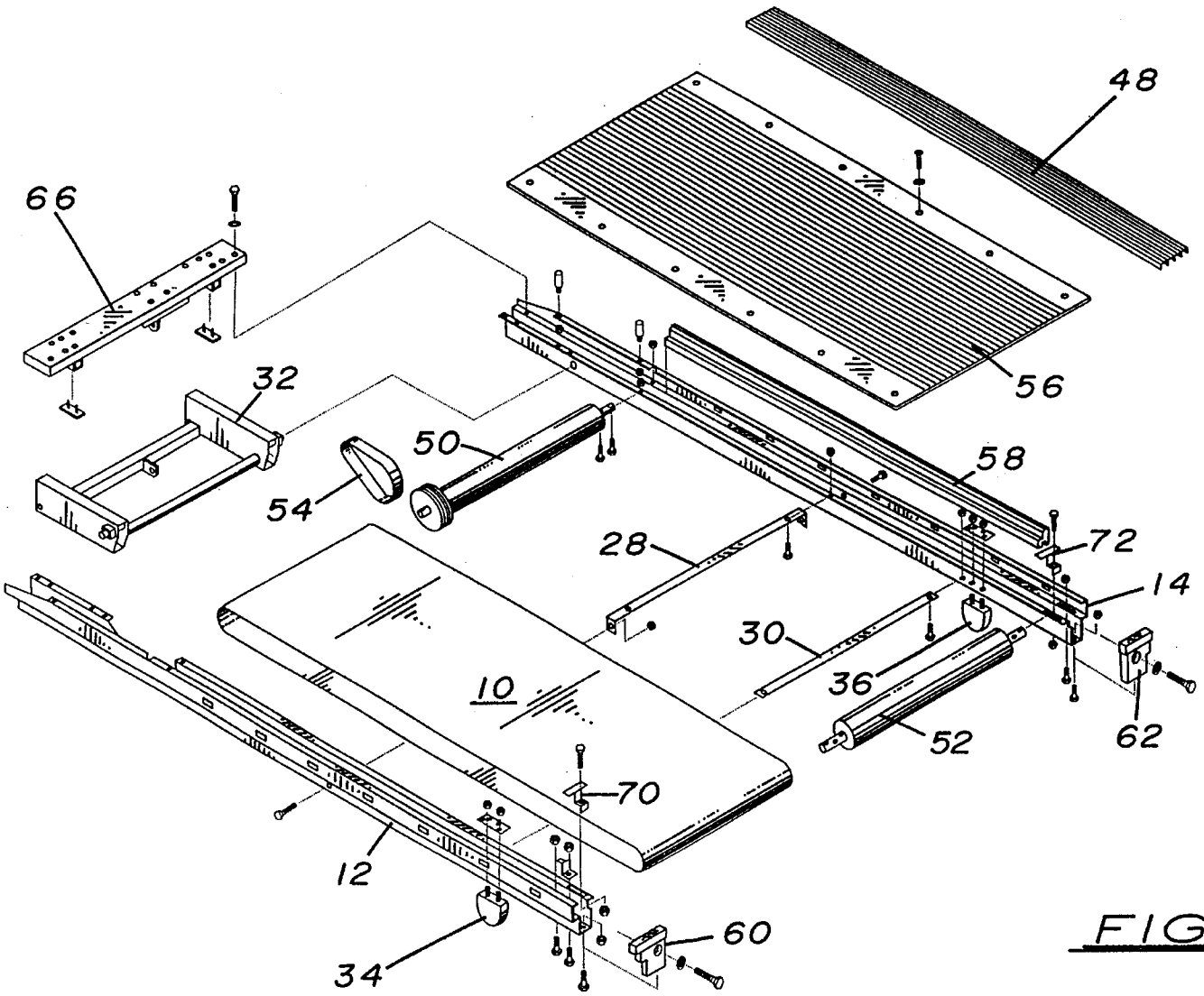
FIG. 3 is an exploded view of various parts of the frame of the treadmill shown in FIG. 1.

The preferred embodiment is illustrated in FIGS. 1–10. As shown in FIG. 1, this treadmill comprises a motor driven tread belt 10, and an underlying frame with left and right side rails 12, 14. Extending above the belt 10 are left and right uprights 16, 18 on which control panel 20 and hand grip 22 are mounted and to which left and right hand rails 24, 26 are attached at the upper ends thereof. Side rails 12, 14 are tied together by front and rear cross pieces 28, 30 (FIG. 3), front cross tube 66, and front and rear rollers 50, 52 (FIG. 3). The rear of the side rails is supported by left and right feet 34, 36 (FIG. 3), which serve as fulcrums when the front end of the treadmill is raised or lowered. Forwardly the treadmill is supported by the lift frame 32 and its forwardly placed wheels, the left one 38 of which is shown in FIGS. 1 and 2.

Drive motor 40 and lift motor assembly 42 (FIG. 2) and associated components are housed under hood 44 (FIGS. 1 and 2).

Also shown in FIGS. 1 and 2 are respective left and right landing strips 46, 48.

Further components shown on FIG. 2 or FIG. 3, or both, include side rail end caps 60, 62, motor pan 64, nosepiece 68, respective left and right roller guards 70, 72, motor mount cross tube 84, lower PCB motor controller 86, flywheel 94, inductor 102, capacitor 106, strain relief line 108, mounting bracket 110 and power cord 120.

Figure 3A:
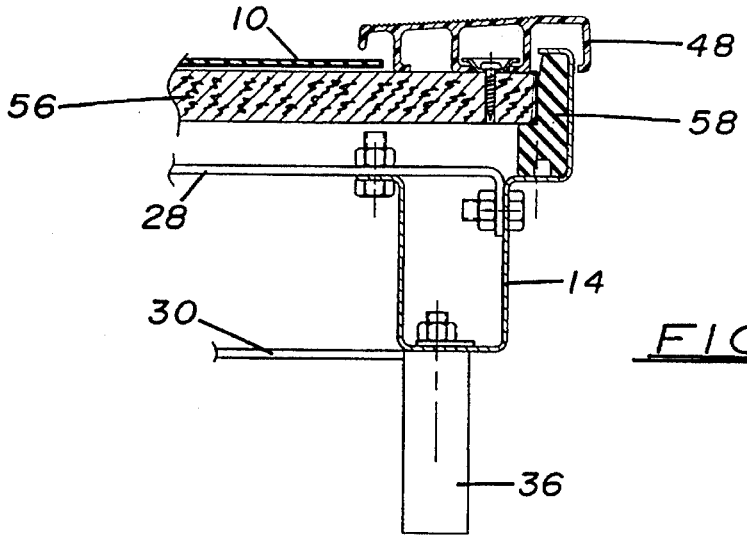
FIG. 3A is an enlarged detail view of the belt, deck and deck support assembly of the treadmill shown in FIG. 1.
Figure 4:
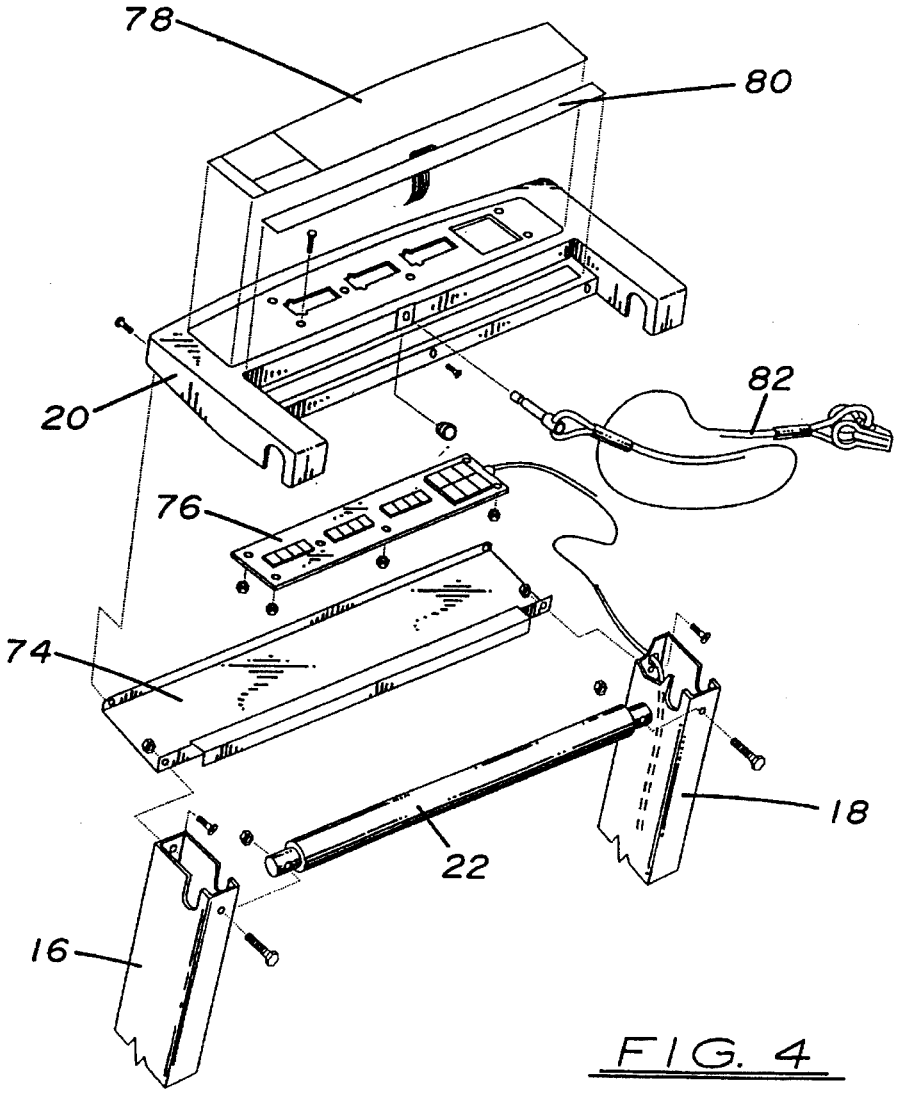
FIG. 4 Is an exploded view of the control panel and associated parts of the treadmill shown in FIG. 1.
Figure 5:
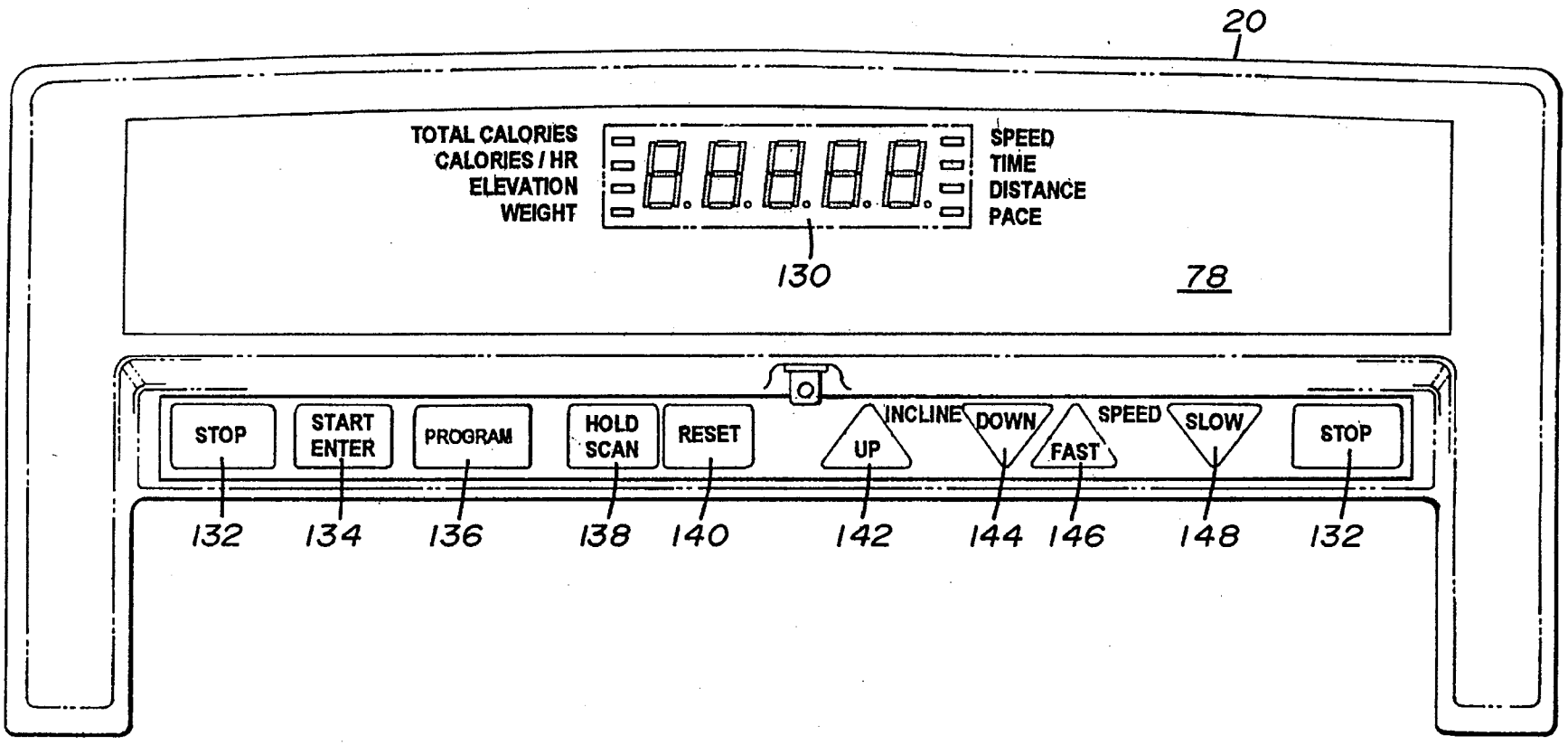
FIG. 5 is a detailed view on an enlarged scale of the control panel layout of the treadmill shown in FIG. 1.

As shown primarily in FIGS. 3 and 3A, one aspect of the present invention is the even and consistent degree of resiliency of the deck 56 when subjected to intermittent and variable foot plant forces. In this connection, the endless tread belt 10 is supported along its upper run on deck 56 and courses front drive roller 50 and rear tension roller 52. Front drive roller 50 is driven by drive belt 54 and is in turn driven by the drive motor 40. Rigid deck 56 is in turn supported on respective side rails 12, 14 by left and right longitudinally extending resilient elastomeric strips of generally L-shape cross-section, the right strip being shown in FIG. 3 at 58, which extend the full length of the sides of the deck 56 and provide limited but controlled slight resiliency to impact induced movement of the deck 56.

FIG. 3A is a detailed, cross-sectional view of the assembled belt 10, deck 56 and strip 58 on the right side rail 14 to further illustrate this arrangement by which the tread belt 10 is given a slight but controlled degree of resiliency. The deck and strip arrangement on the left side rail 12 is the mirror image of the arrangement shown in FIG. 3A. As will be evident, both the bottom and side edges of the deck 56 engage the strip 58 (and the left mirror image thereof) enable some degree of resiliency for slight movement of the deck 56 horizontally as well as vertically because the support of the deck 56 on the side rails 12, 14 is entirely through the resilient strips (strip 58 and it mirror image).

As a specific example of the tread belt and deck arrangement described, the tread belt can be a two-ply running belt with textured PVC top cover and non-stretch polyester backing, the deck 56 can be rigid, ¾ inch thick medium density fiberboard (MDF) with a 30—30 phenolic paper cover to render it self-lubricating, and the resilient left and right strips can be ethylene propylene polymer (EPM) synthetic rubber of 55±5 Durometer Shore A hardness rating. The resilient strips can be fabricated by casting or other forming technique, if desired.

Figure 6:
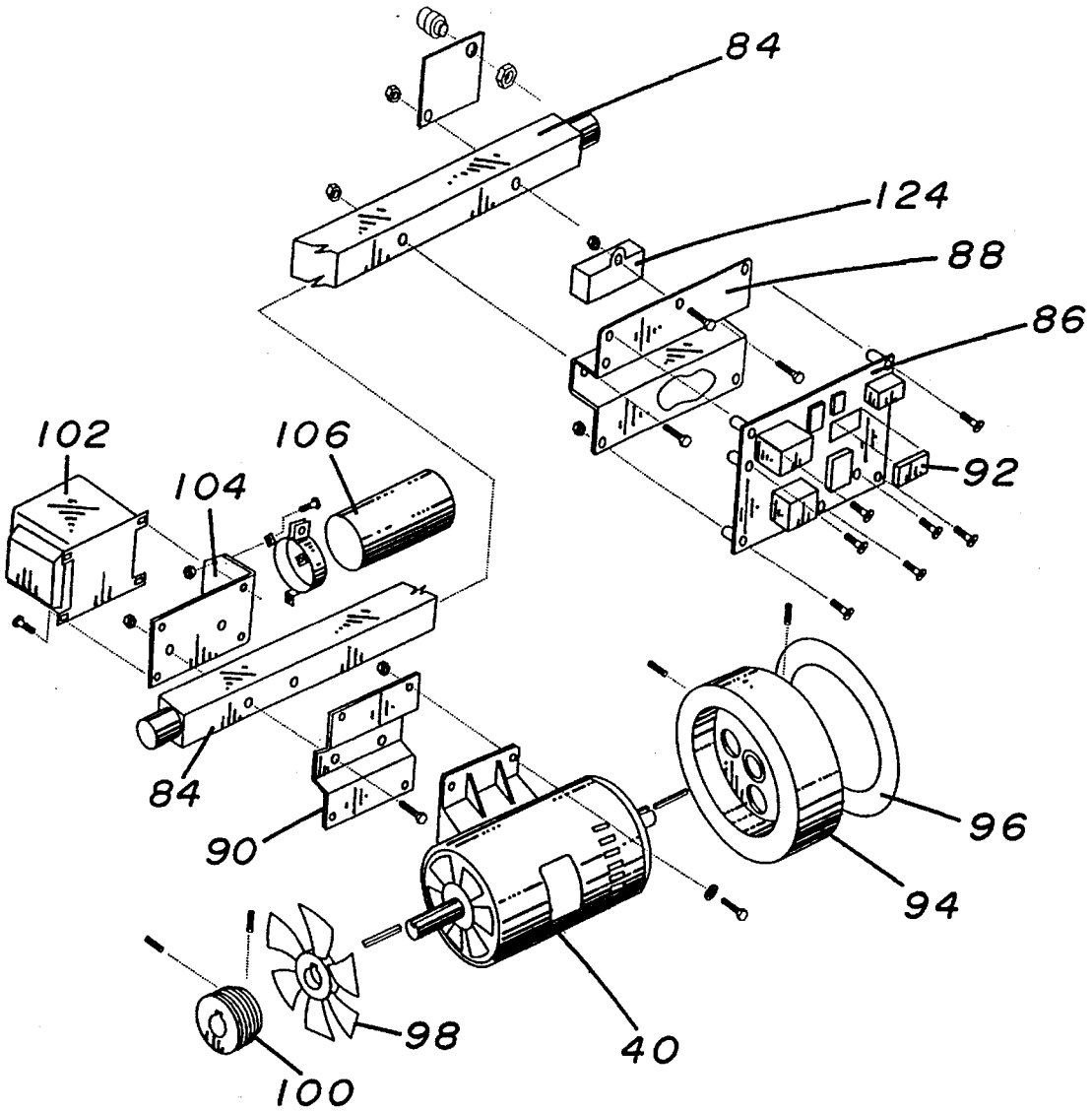
FIG. 6 is an exploded view of the drive motor and motor controller of the treadmill shown in FIG. 1.

Considering the components of the drive motor assembly as shown primarily in FIG. 6, the belt drive motor 40 is mounted on motor mount crosstube 84, utilizing motor mounting plate 90 and the lower PCB motor controller 86 is also mounted on the motor mount crosstube 84 by means of PCB mounting plate 88. Similarly, the drive motor 40 is mounted on the motor mount crosstube 84 utilizing motor mounting plate 90. As discussed more fully below, the lower PCB motor controller 86 comprises EPROM 92.

Drive motor 40 through its rotor shaft drives flywheel 94 and flywheel target 96 as well as fan 98 and motor drive pulley 100. Inductor 102 and inductor mount 104 as well as associated drive motor capacitor 106 are also mounted on motor mount cross tube 84, and strain relief line 108 (protecting the power cord 120) and its bracket 110 also mount on the crosstube 84.

Miscellaneous fasteners and other detail components are shown on the drawings, the purposes and interrelation of which with the components discussed are believed well known per se and self-evident.

Figure 7:
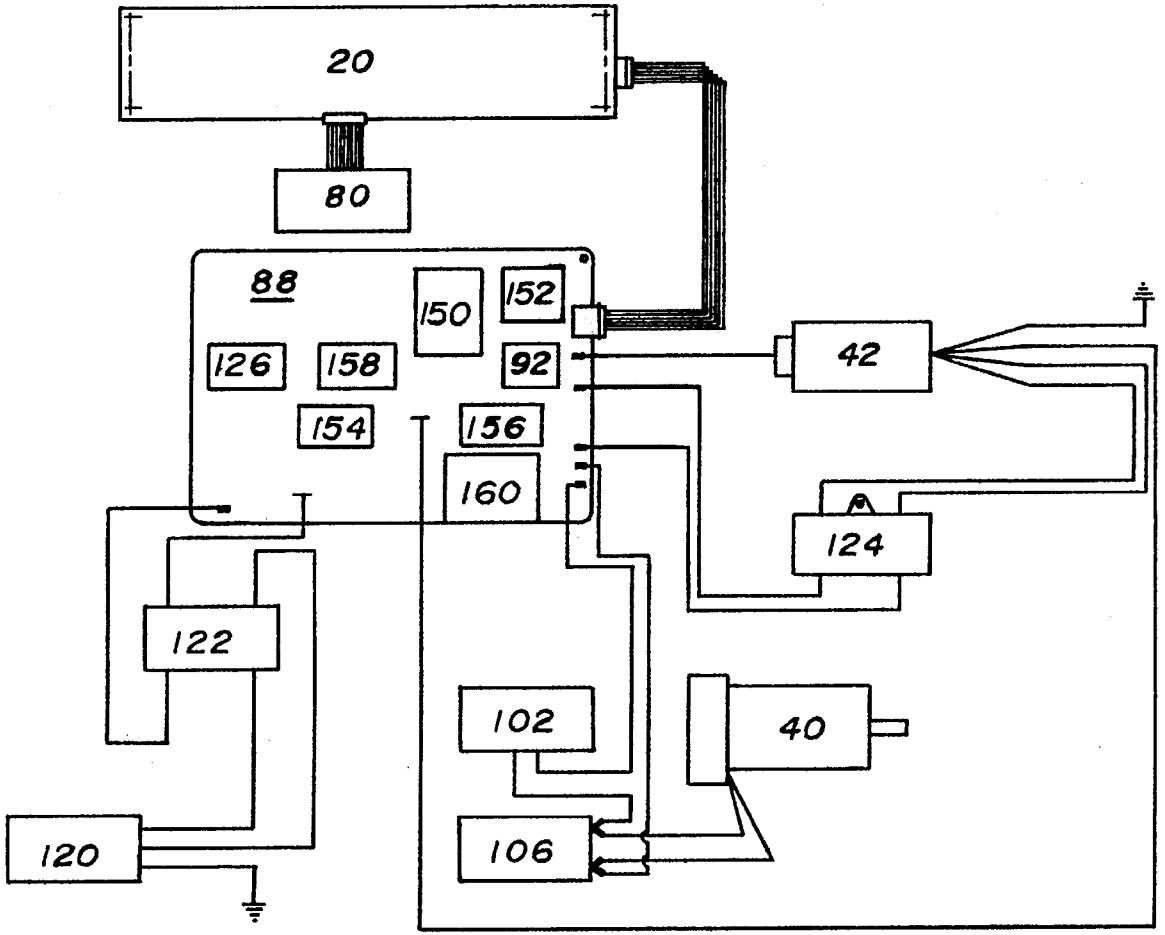
FIG. 7 is a schematic of the electrical circuit of the treadmill shown in FIG. 1.

The electrical block diagram of FIG. 7 shows in general the electrical components of the treadmill. The heart of the motor control system is the motor controller printed circuit board PCB 88 which receives power input from power cord 120 through circuit breaker 122. Control inputs are received from the upper PCB control panel 20 and associated key pad 80. Control outputs from the motor controller 88, governed by its program memory (EPROM) 92 and the control inputs from the control panel 20 and key pad 80 are to the drive motor 40 and its associated inductor 102 and capacitor 106 and to lift motor 42 and its associated capacitor 124.

As shown in FIG. 7, the motor controller board 88 includes several components which are part of the impact control system of the present invention. As previously indicated, the board 88 carries the program memory 92 (suitably a 27C512) and the reflective speed sensor 126 which is pulsed by flywheel target 96. In addition, the board mounted motor control system components include microprocessor 150 (suitably an Intel 80C51FA), an address latch 152 (suitably a 74HC573), a zero crossing detector 154 (operating at a frequency of 120 Hz, derived from the AC line), an optoisolator 156 (suitably an IL420), a 16 MHz Oscillator crystal 158, and a full wave SCR phase control power module 160.

Figure 8:
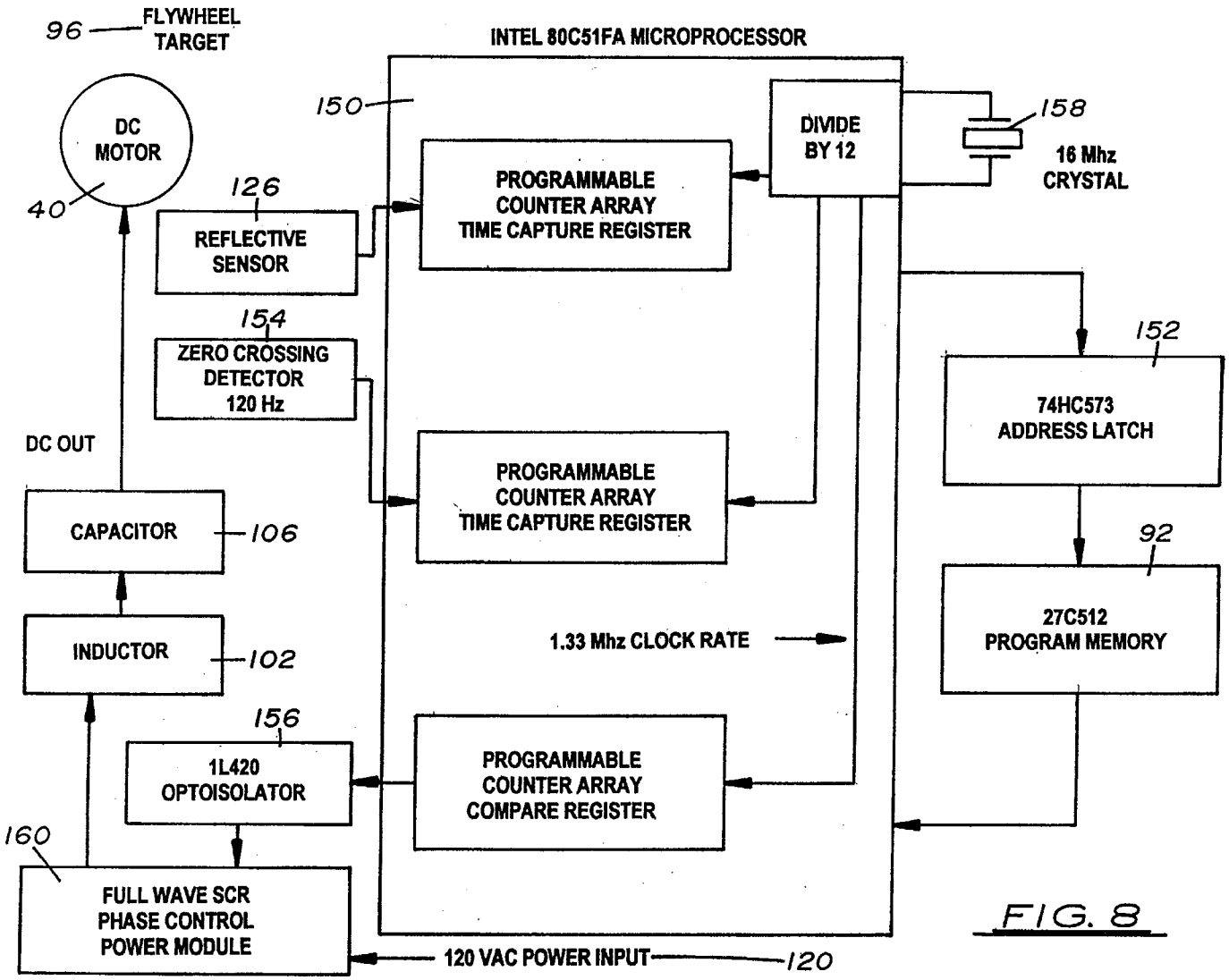
FIG. 8 is a block diagram of the control system of the treadmill shown in FIG. 1.

FIG. 8 is a block diagram further showing the motor controller and control system components. As there indicated, the programmable counter arrays in the microprocessor 150 operate at a clock rate of 1.33 MHz, derived from crystal input 158. The power module 160 and its control output to the DC drive motor 40 are in turn controlled by the microprocessor 150 through inputs with respect to tread speed from reflective sensor 126 and zero crossing detector 154 along with "feel" level control inputs from the program memory 92 in which there are delta gain, loop gain and maximum power gain lookup tables correlating tread speed and feel level.

FIG. 9 presents in tabular form three exemplary lookup tables showing various values available in EPROM 92 where each of the selectable "feel" values F1 through F9 as related to each of the belt speed values in one-half mile per hour (MPH) increments. The first number in each three numeral number in the table is the "delta gain" value, the second number in each three numeral number is the "loop gain" value, and the third number in each three numeral number is the "maximum power" value.

Another term for the delta gain is a.c. gain and another term for loop gain is d.c. gain (actually the reciprocal of gain factor).

When the user requests the belt drive motor to start or to change speed by appropriate input at the treadmill keyboard 90, the treadmill micorprocessor 150 recovers a selected "feel" value from the computer's memory (a designation from F1 to F9) and the requested speed value (a number between 0.0 and 11.0) and with the selected designation and value enters the lookup tables. It first finds the delta gain value, then takes this value and converts it to a more usable form for later use of the motor control portion of the computer program. This more usable value for delta gain, which can also be called its surrogate value (and in the example presented a number between 35 and 110), is then saved in the computer's microprocessor 150. The correlation between the FIG. 9 speed value and "feel" designation and the corresponding surrogate values for delta gain, loop gain, and maximum power figures is shown in FIG. 10. Again using the selected "feel" designation and requested speed to look up the selected loop gain value in the loop gain lookup table, the computer then converts this value to the more usable form for a later use in the motor control portion of the computer program. This more usable value for loop gain, as noted in FIG. 10, is a number between 4 and 12. This number is then saved in the computer memory. The computer again uses the selected "feel" designation and requested speed to look up a value in the maximum power lookup table, then converts this value to the more usable surrogate form for later use in the motor control portion of the computer program. As shown in FIG. 10, this more usable surrogate value is a number between 110 and 9000, which is then saved in the computer's memory 92.

The computer 150 then uses these three values (delta gain, loop gain, and maximum power), together with the current tach period (surrogate for current speed) and the desired tach period (surrogate for requested speed) and the previous tach period (current tach period minus previous tach period is a surrogate for motor acceleration or deceleration) to control the treadmill motor in reaching and maintaining the user requested speed.

As an example of use of the lookup tables, assuming the user has selected "feel" F6 with the current treadmill speed being 4.7 MPH, and assuming the user then requests via the keyboard that the speed increase to 4.8 MPH, the delta gain lookup table value for "feel" F6 and speed 4.8 is 6, equating to a surrogate value of 70. The loop gain lookup table value for "feel" F6 and speed 4.8 is 2, equating to a surrogate value of 8. The maximum power lookup table value for "feel" F6 and speed 4.8 is 6, equating to a surrogate value of 2200.

The following are examples of calculations of SCR power module delay at different "feel" settings. As will be readily recognized, SCR delays are calculated within the motor controller more than 100 times each second and are updated essentially continuously, so the following example is actually of a substantially instantaneous single calculation at a single instant in time. For the following example, the following assumptions are made.

Actual belt speed: approximately 6.0 mph

Target speed: 6.5 mph

Period goal for speed of 6.5 mph: 3200 microseconds

Last tachometer period: 3526 microseconds

Current tachometer period: 3456 microseconds

Last SCR delay: 4000 microseconds

For the case of "feel" selection F1:

FIGS. 9 and 10 give the following values:

Delta gain=70

Loop gain=8

Max power=110

Let new tach period=3456/8

Let old tach period=3526/8

(The periods are divided by 8 to get better period resolutions and therefore smoother speed control at high speeds.)

Let raw delta=new tach period–old tach period= (3456/8)–(3526/8)=–8

(Integer arithmetic is used, fractions and decimals are dropped.)

Let raw delta=(raw delta) * (delta gain)= (–8)*(70)=–560

Let error signal=(18000+raw delta)+new tach period= (18000+(–560))+433=17873

(The 18000 is inserted to make the arithmetic work better.)

The program now tests the calculated error signal to determine if the drive motor is running too fast or too slow.

Is error signal greater than (18001+period goal)?

17873 is not greater than (18001+3200/8)=18401

Is error signal less than (17999+period goal)?

17873 is less than (17999+3200/8)=18399. Therefore motor is running too fast.

Let error signal=(period goal+18000)–error signal=400+18000–17873=527

The program then tests to see if the resulting error signal is to be constrained by the maximum power level for the given feel setting.

Is error signal greater than maximum power change?

527 is greater than 110, therefore limit error signal to a value of 110.

$$\text{New } SCR \text{ delay} = \text{old } SCR \text{ delay} + (\text{error signal/loop gain}) = 4000 + (110/8) = 4013 \text{ microseconds}$$

For the case of "feel" selection F9:

Delta gain=110

Loop gain=4

Max power=9000

New tach period=3456/8

Old tach period=3526/8

Raw delta=–8

Let raw delta=(–8)*(110)=–800

Error signal=(18000+(–880)+433+17553

The error signal is less than 18399, so the motor is running too fast.

Let error signal=400+18000–17553+848

The error signal is not larger than 9000, which is the maximum power level for this feel setting, so the error signal value remains 847.

The new SCR delay becomes for this case:

4000+(847/4)=4211 microseconds

As known per se, an SCR acts very much like a switch. It is turned on by applying a pulse to the gate input and once turned on it remains on, conducting current just like any closed electrical switch, until the current through the SCR is removed. When used with a.c. power, the SCR turns off each time the a.c. voltage passes through zero volts and at 60 Hz a.c. it does so 120 times per second or every 8.33 milliseconds. To control power, with the SCR acting like a switch, the ratio between the on-time and the off-time of the SCR is varied in order to vary the average power output.

The treadmill motor control system shown detects each zero crossing of the incoming a.c. power supply by means of zero crossing detector 154. As the incoming power crosses the zero voltage point, the microprocessor 150 notes the precise time in microseconds of this event. If the processor were to generate a pulse in this instant to fire the SCR in the SCR power module, the SCR would turn on and remain on for the current half cycle of the incoming power. This would result in full power being supplied to the motor 40. The power half cycles are of 8333 microseconds duration. If the SCR is fired 4167 microseconds after zero crossing, the SCR is on for one-half of the half cycle. This would result in 50% power output. By adjusting the delay time from zero crossing detection to the time of filing, the SCR power output is controllable over a range of 0% to very near 100%. In the control system utilized in the treadmill discussed, the actual implementation is as follows:

The Intel ADC51FA microprocessor 150 includes a 16 bit counter running continuously at the rate of 1.333 million counts per second. It increments every microsecond. Certain inputs are able to cause the internal register to capture the precise count of this counter. On each zero crossing the current count is captured. Assume for a moment that the count is 45124 at an instant of a zero crossing. Assume further that a 50% power level is desired by the SCR module from the current half-cycle. The microprocessor also includes digital circuitry which allows comparison between a value in a specified register and the aforementioned counter. When the counter value equals the comparison register, a pulse is developed. So at or near zero crossing time, the comparison register is set to the 45124 count plus 4167 (corresponding to 50% power as described above). When the free-running counter reaches the count of 49291, an SCR firing pulse is generated with the result that a 50% power output from the SCR module is obtained.

The SCR module consists of diodes and SCRs in an arrangement that allows phase control (varying the delay of the trigger pulse from the zero crossing time) of the incoming a.c. to be converted to a pulsating d.c. signal. The on-time of the pulsating d.c. signal is under microprocessor control as described above. The pulsating d.c. passes through a large inductor 102 and is further filtered by a capacitor 106 before being applied to the motor 40 which drives the treadmill running belt 10.

Manifestly, in the control system illustrated, if a given treadmill belt speed is to be increased, the power output to the drive motor should be increased. In general, if the change is negative and the SCR firing delay is thus reduced, this results in increased power delivered to the motor and an increase in belt speed. If the change is positive, power and belt speed are reduced.

For an understanding of the nature of the tread belt speed control characteristic of the present invention, it is first to be noted that the drive motor control system disclosed is a closed loop control system. In its simplest form, the controller compares the actual motor speed in any given instance to the desired speed and is to either speed up or slow down the motor to correct any error. To make such correction instantaneously would tend to make the tread belt very stiff and subject to overshoot and undershoot as well as to be unstable. The control, to be more realistic, Rust take into consideration not only the instantaneous belt speed, but the rate of change of speed. For example, if the system is asked to provide a belt speed of 9.0 mph and the actual speed is 8.5 mph, that does not necessarily mean that the power to the motor should be increased. It may be that the speed has just changed from 8.0 to 8.5 very quickly, and a reduction in power is needed to keep from ending up at a speed of 10 or 12 mph.

In a closed loop control system, it is desired that the controller reduce the error signal it sees to zero. The error signal is not, however, simply the difference between actual and desired speeds, as it is not sufficient to change zero speed error. It is necessary to achieve zero speed error and zero rate of change, otherwise the control system just passes through the correct speed on the way to some other speed.

Mathematically, both the speed error and the first derivative (i.e. the rate of change) of the speed is to be zero. This can be expressed as:

$$ERROR=A^*\ (DESIRED-ACTUAL)-B^*\ (ACTUAL-OLD)$$

where

DESIRED is the desired speed,

ACTUAL is the present actual speed,

OLD was the actual speed at the time of the last prior measurement, and A & B re constants.

Note that the error signal as defined above is the difference, not the sum, between the speed error term [A* (DESIRED–ACTUAL)] and the rate of change term [B*(ACTUAL–OLD)]. If the speed error is positive (too slow), but the rate of change is also positive (accelerating), the total error is diminished. If too slow, and slowing further (positive speed error and negative rate of change), the overall error would be increased. The relative contributions, or weightings, of the speed error and rate of change terms are determined by the constants A & B.

At equilibrium, both terms of the error equation are to be zero, or $$A^*(DESIRED-ACTUAL)=B^*(ACTUAL-OLD)=0$$

This is the condition the controller is seeking, where speed is where desired, and unchanging.

The control circuit disclosed does not, however, measure speed. Rather, it detects marks on the motor flywheel, and measures the time period elapsed between seeing one mark and the next. This period is, of course, inversely proportional to speed, so the controller could compute speed from this information. But, if the error equation is changed accordingly, the controller can use the period information directly. Thus, the error equation can be rewritten:

$$ERROR=A^*(PG-NTP)-B^*(NTP-OTP)$$

where

PG is the "period goal" corresponding to the desired speed,

NTP is the "new tachometer period" corresponding to present actual speed,

OTP is the "old tachometer period" corresponding to actual speed at the time of the last prior measurement, and A & B are still constants, although they would have different values than in the previous equation.

The equation still has two terms, which can now simply be called "period" and "rate" errors. This is an error equation the controller can work with directly, because it is in terms of the "tachometer periods" the controller measures. The only difference between this and the previous, speed based equation is that the signs of the errors are reversed. In the speed equation, for example, being too slow results in a positive error term, while in the period equation, being too slow (i.e. a period longer than desired) results in a negative error term. The controller program can easily accommodate this difference.

What is the role of the constants, A & B? These are described earlier as weighting factors which determine the relative contributions of the period and rate terms, respectively. When either of the error terms is zero, the value of its weighting factor is of course irrelevant, but when there are errors in period and rate, these factors determine how much weight, or importance, the controller assigns to each of the two error terms.

How are these constants determined? First, considering that one needs only to assign a relative weight to two factors, one of the constants can arbitrarily be set equal to one. Defining A=1, and replacing B with DF (for "delta factor") to be consistent with the above terminology, the equation becomes:

$$ERROR=PG-NTP=(NTP-OTP)*DF$$

The faster the rate of change of speed, the more important it is to be factoring it into the error equation, or the more its term should be weighted. What is needed then, is to have DF increase when the treadmill speed is controlled more aggressively, i.e. more stiffly or with more power (a higher "feel" setting). That will help the controller respond without overshoot or oscillation. At softer feel settings, DF can be reduced.

So far, the equation gives an error signal based on two terms, period error and rate error. What is the response of the controller to a given error signal? The controller should adjust the SCR delay to reduce the error to zero, but how sensitive should the controller be, i.e. how much of a change in SCR delay should it produce for some magnitude of error signal? Mathematically.

$$CHANGE\ IN\ SCR\ DELAY=GAIN*ERROR,$$

where ERROR is calculated per the equation above, and GAIN is as defined below.

In the treadmill application, more gain is desired for stiffer feel; less gain for softer feel, where it is desired to allow a greater deviation in speed before correcting it. The equations then look like this:

$$CHANGE\ IN\ SCR\ DELAY=GAIN*ERROR$$

or, since (from above) ERROR=PG=NTP−(NTP−OTP)*DF, $$CHANGE\ IN\ SCR\ DELAY=GAIN*[PG-NTP-(NTP-OTP)*DF]$$

For reasons related to the microprocessor (or memory), the disclosed design does not store a value for gain, but rather for a quantity called "loop gain" (LG), which is the reciprocal of gain. For reasons, again microprocessor related, a constant divisor of eight is also introduced, so the above equation becomes:

$$CHANGE\ IN\ SCR\ DELAY=[1/(8*LG)]*[PG-(NTP-OTP)*DF]$$

The motor control equation can now be completed. The term for CHANGE IN SCR DELAY is defined above. If the change in SCR delay is known as well as the previous SCR delay (which has been stored in memory), then the new SCR delay can be calculated as follows:

$$SD=PSD+CHANGE\ IN\ SCR\ DELAY.$$

where SD is the new SCR delay, and

PSD is the previous SCR delay, and $$CHANGE\ IN\ SCR\ DELAY=[1/(8*LG)]*[PG-NTP-(NTP-OTP)*DF].$$

So:

$$SD=PSD+[1/(8*LG)]*[PG-NTP-(NTP-OTP)*DF]$$

This equation determines the SCR delay under all conditions except one, and that is when the error signal exceeds a predetermined value called MPC (maximum power change). In the event a change exceeding the MPC value is called for, the MPC value is used as a limit.

So:

$$SD=PSD-(1/LG)(MPC) \text{ or } SD=PSD+(1/LG)(MPC)$$

depending upon the direction of the error.

Actually, this condition can happen quite regularly, with foot plants. The value of MPC thus is critical to the "feel" of the treadmill, for this factor determines how strongly and how quickly the belt recovers from a foot plant.

In addition, MPC is used to limit the maximum peak power the treadmill takes from the power line, thus allowing operation from a lower rated service (15 amp) than might otherwise be required.

The motor control equation is accordingly completely defined, with the exception of three parameters: MPC, DF, and LG. Where do these come from?

In the disclosed treadmill these values are retrieved from memory. The user does not have direct control of the parameters. He cannot set any combination he wants. While that capability could be easily provided, it would be confusing to set the treadmill, and difficult to repeat, since three different parameters are involved, each of which may be beneficially changed with speed as well. In order to simplify this process, this invention provides nine preset "feel" levels. Each level has a particular combination of MPC, LG, and DF values, and these change with programmed speed.

The novelty of the speed control implementation of the present invention is that the drive motor control constants that are conventionally established by the manufacturer and provide but one given preset performance mode as to tread belt "feel" are now variably selectable by the user during use of the treadmill. This avoids the problem in conventional treadmill design practice which necessarily involved a built-in, unchangeable compromise between aggressive and sloppy response to foot impact induced motor speed variation.

The illustrated treadmill has a number of features other than the provision of selective control of the degree of responsiveness to impact on the treadmill belt. It offers a variety of programs which can to a degree interact with or be modified by selective impact control. To illustrate this aspect, reference is made to the key pad and control panel and the greater detail thereof shown in FIG. 5. The control panel 20 with its associated label 78 presents an alphanumeric display 130 which also includes a selective scan mode indication as to total calories, calories per minute, elevation, weight, speed, time, distance and pace. The key pad 80 has stop keys 132, a start/enter key 134, a program key 136, a hold/scan key 138, a reset key 140, incline up and incline down keys 142, 144, and fast and slow speed keys 146, 148.

The starting or restarting of the treadmill is initiated by pressing of the start/enter key 134. Pressing one of the stop keys 132 stops the treadmill motor and running belt and when in a program mode exits the program or when entering a program ends the program at the point where the key is pushed. Program key 136 offers a selection of a program, e.g. any one of eight exercise sequences in the example selected. Pressing of the hold/scan key 138 stops and starts the scan mode which displays at three second intervals each of the eight modes designated by indicator lights adjacent the alpha-numeric display. Pushing of the reset key 140 clears the readings of calories, time and distance, and resets the display, and when in the program mode accesses an editing function for specific programs. Pressing of the up or down keys 142, 144 raises or lowers the treadmill incline in one-half degree increments, also allows adjustments of weight in one pound increments, and also allows change in the "feel" mode (the variable foot plant adjustment), from F-1 (soft) to F-9 (stiff). When in a program mode, these keys 142, 144 also enable selection of any one of the exercise sequences Program 1 through Program 8. Pressing of one of the fast/slow keys 146, 148 increases or decreases the belt speed in 0.1-MPH increments.

As an example of operation of the treadmill in a given controlled impact mode, the treadmill is first placed in a power-up mode by turning on the power-on switch (not shown), then pressing the start/enter key, then adjusting the weight reading to the weight of the user by using the up and down keys, then pressing the enter key, then indexing the mode with the hold/scan key to the "feel" mode, then selecting the desired "feel" level (F-1 to F-9) using the up and down keys and pressing enter, then when the display panel reads "run", adjusting the speed to the desired speed, using the fast and slow speed keys to adjust the speed. Upon pressing of the fast speed key 146, the running belt starts moving and gradually increases in speed until reaching the selected, nominal speed. Tread belt incline can then be adjusted by the up and down keys in one-half degree increments, if desired. Stopping of the treadmill is accomplished by pressing one of the stop keys, following which the tread belt reduces in speed and stops in approximately four seconds as the display begins a three minute countdown.

The foregoing as a preferred embodiment describes a drive motor control system of a type in which a variable speed DC motor is employed to drive the tread belt with its speed being controlled by an SCR phase control power module and a microprocessor, and with a programmed memory providing several levels of belt drive motor speed restoration rates and consequently several levels of "softness" or "stiffness" from which a user can select a desired restoration rate for the purpose of minimizing foot plant induced stress and trauma. As will be apparent, there are many variations and modifications which can be employed in specific motor and motor control systems to accomplish essentially the same result, both with respect to the nature of the drive motor and drive arrangement for the tread belt, and with respect to the nature of the drive motor control system. As further examples, while the motor control system disclosed above employs tread belt speed detection means in the form of flywheel target 96 (thus equating the drive motor rotational speed with tread belt speed of movement, which in fact is an accurate correlation for purposes of the control mechanism of the present invention because the belt, when properly tensioned on the driving and driven rollers 50, 52 on which it courses and on which the drive belt 54 is also properly tensioned, exhibits essentially no slippage as between the drive motor pulley 100 and the tread belt 10), the belt speed detection can also be by a spot sensor or similar tachometer signal generator or counter acting directly on the belt 10 itself. With regard to the nature of the speed control exerted on the drive motor, rather than utilizing a DC motor controlled by means of an SCR phase control power module, the drive motor can be a constant speed motor coupled to the tread belt driving roller by an eddy current drive, which is a known type of variable, magnetic coupling. With regard to other optional design considerations, the SCR phase control power source can be controlled by way of an analog or digital control circuit means and the SCR phase control power source itself can be replaced by known triac circuitry. Pulse width modulated power source controls for DC drive motors are also known and can be in turn controlled by a microprocessor or analog or digital control circuit means. Still other alternatives are available utilizing AC induction or synchronous motors with variable frequency drives. Still other design variations can be employed for drive motor speed variation such as user controlled, variable resistance means placed in series with the drive motor, with the resistance being increased to limit the response of the motor to sudden increases in load (foot plants) and thus "soften" the feel of the treadmill. Such a variable resistance can be a user controlled semiconductor device that is a transistor or a user controlled SCR phase control placed in series with the motor for purposes of reducing the motor voltage. The same manner of control can be effected with triac type phase control and with pulse width modulated phase control in series with the motor. Mechanically variable belt driven transmissions can also be employed. As will also be apparent, the earlier discussed variations involving eddy current type variable speed drive can be used with AC induction motors running at nominally constant speed as well as with constant speed DC motors. Notwithstanding that there are several known types of treadmill belt drive motors usable with several types of power transmissions, in turn employable with several types of control circuitry, it is unique with the present invention to provide in any such power drive and belt speed control system a plurality of treadmill tread belt speed restoration regimes from which a treadmill user may select any given one considered by the user to be best suited for his or her individual comfort during use of the treadmill.

As will be apparent, a wide variety of exercise programs, in terms of variation in time, speed, tread incline and "feel" can be achieved, with either an automatically programmed workout or manually controlled workout regime.

As will be also understood, various modifications and adaptations of the treadmill components and modes of operation discussed in connection with the preferred embodiments presented will occur to those skilled in the art to which the invention is addressed, within the scope of the following claims.

What is claimed is:

1. An exercise apparatus having a moving tread belt on which a user runs or walks while exercising, said apparatus comprising:

power drive means for driving the moving tread belt, and means for varying the tread belt speed including a speed control system, including:

user-operated control means for selecting a desired tread belt speed; and user-operated speed control means for establishing a selected rate of restoration of the tread belt speed upon the occurrence of a change in load on the moving tread belt;

said user-operated speed control means also including means for selecting a different rate of restoration of the tread belt speed to reduce user foot plant induced stress and trauma.

2. An exercise apparatus according to claim 1, comprising means sensing the rotational speed of said power drive means as a measure of said tread belt speed.

3. An exercise apparatus according to claim 1, wherein said power drive means comprises an electric motor and said speed sensing means comprises means for sensing the rotational speed of said electric motor.

4. An exercise apparatus according to claim 3, wherein said motor means is a d.c. motor.

5. An exercise apparatus according to claim 1, wherein said power drive means comprises a variable speed d.c. motor and said user-operated control means for selecting any one of several available belt drive motor speeds comprises an SCR phase control power module.

6. An exercise apparatus according to claim 5, further comprising a microprocessor and programmed memory controlling said SCR phase control power module.

7. An exercise apparatus according to claim 1, wherein said user-operated speed control means for establishing a selected rate of restoration of the tread belt speed comprises means for selecting any one of several rates of restoration of the tread belt speed, including a program memory having plural sets of program values, and means for transmitting a selective set of such program values as inputs to said user-operated speed control means.

8. An exercise apparatus having a moving tread belt on which a user runs or walks while exercising, said apparatus comprising:

motor means for driving the moving tread belt, a speed control system for varying the belt drive motor speed, said control system including:

user-operated control means for selecting any one of several available belt drive motor speeds, and user-operated control means for establishing a desired rate of restoration of the belt drive motor speed upon the occurrence of a change in load on the moving tread belt; said user-operated control means also including means for selecting any one of several different rates of restoration of the belt drive motor speed to minimize user foot plant induced stress and trauma.

9. An exercise apparatus comprising:

an endless, movable tread belt on which a user runs or walks while exercising;

power driven means for driving the movable tread belt, including speed control means for selecting any desired one of several available tread belt nominal speeds;

said tread belt speed control means further comprising means providing several available different rates of restoration of tread belt speed which function to respond to dynamic change in tread belt speed when the tread belt is subject to user foot plant impact, and means by which the user can select any desired one of the several available different rates of restoration of tread belt speed to reduce the stress and trauma caused by the foot plant impact variation in tread belt speed.

10. A treadmill comprising an endless tread belt on which a user exercises by running or walking comprising:

a drive motor for moving said tread belt;

drive motor speed control means including an SCR phase control power module for controlling the amount of power delivered to said drive motor;

a microprocessor receiving as inputs indications of drive motor speed and power input zero crossing, as well as user-selected desired rate of response to change in belt speed caused by user foot plant impact on the belt, said microprocessor including program memory with plural sets of program values corresponding to plural rates of restoration of drive motor speed following foot plant impact with the belt and corresponding to plural tread belt speeds.

11. A treadmill according to claim 10, wherein said program memory includes several different sets of program values corresponding to plural rates of drive motor speed restoration following foot plant impact and several different nominal tread belt speeds, the said program values corresponding to respective delta gain, loop gain and maximum power values for each such rate of speed restoration and each such nominal tread belt speed.

* * * * *